US005735634A

United States Patent [19]

Ulrich et al.

[11] Patent Number: 5,735,634

[45] Date of Patent: Apr. 7, 1998

[54] ROAD FINISHER AND A METHOD OF APPLYING SURFACE LAYERS

[75] Inventors: Alfred Ulrich, Gorxheimertal; Erich Resch; Günter Zegowitz, both of Mannheim, all of Germany

[73] Assignee: Joseph Vogele AG, Mannheim, Germany

[21] Appl. No.: 666,830

[22] Filed: Jun. 19, 1996

[30] Foreign Application Priority Data

Jun. 21, 1995 [DE] Germany ..... 295 10 058.3

[51] Int. Cl.[6] ..... E01C 19/22; E01C 19/40; E01C 19/48

[52] U.S. Cl. ..... 404/102; 404/108; 404/111; 404/114; 404/133.2

[58] Field of Search ..... 404/114, 113, 404/118, 119, 102, 133.05, 133.2, 111, 104, 108

[56] References Cited

U.S. PATENT DOCUMENTS

| | | | |
|---|---|---|---|
| 3,841,777 | 10/1974 | Domenighetti | 404/84 |
| 4,073,592 | 2/1978 | Godberson et al. . | |
| 4,124,325 | 11/1978 | Cutler | 404/75 |
| 4,473,320 | 9/1984 | Register | 404/91 |
| 4,594,022 | 6/1986 | Jeppson | 404/28 |
| 4,948,292 | 8/1990 | Haven et al. | 404/84 |
| 5,201,603 | 4/1993 | Bassett et al. | 404/84.1 |
| 5,217,320 | 6/1993 | Cioffi | 404/133.2 |
| 5,348,418 | 9/1994 | Campbell | 404/103 |
| 5,516,231 | 5/1996 | Helms et al. | 404/114 X |

FOREIGN PATENT DOCUMENTS

| | | | |
|---|---|---|---|
| 0 536 052 A1 | 4/1993 | European Pat. Off. . | |
| 2 697 036 | 4/1994 | France . | |
| 23 14 812 | 3/1973 | Germany . | |
| 31 14 049 A1 | 10/1982 | Germany . | |
| 93 13 161.5 | 12/1993 | Germany . | |
| 9217124 U | 4/1995 | Germany . | |
| 43 42 997 A1 | 6/1995 | Germany . | |
| 1073357 | 2/1984 | U.S.S.R. | 404/108 |
| 372267 | 10/1932 | United Kingdom | 404/108 |

*Primary Examiner*—James Lisehora

*Attorney, Agent, or Firm*—Finnegan, Henderson, Farabow, Garrett & Dunner L.L.P.

[57] ABSTRACT

A road finisher, which is used for simultaneously applying at least two surface layers comprises a chassis, a travelling mechanism, at least two premix containers arranged on said chassis, a lateral distributor associated with the respective premix container and adapted to have material supplied thereto via a conveyor path extending in the chassis, and lateral outriggers attached to the chassis as well as a dragged road-surface applying device used for applying a surface layer and arranged on said outriggers, all road-surface applying devices being high-compaction road-surface applying screeds for recompaction-free application of a surface layer, and each high-compaction road-surface applying screed constituting a rear screed, when seen in the direction of movement, which is constructed as a high-compaction road-surface applying screed which is adapted to be used for applying and compacting concrete. In the method of applying surface layers by use of such a road finisher, the surface layers are applied one immediately after the other and in one operation in such a way that each first surface layer is highly compacted during application to such a degree that recompaction is no longer necessary and each following surface layer is applied to the highly-compacted surface layer and then, in turn, highly compacted to such a degree that recompaction is no longer necessary.

8 Claims, 2 Drawing Sheets

ROAD FINISHER AND A METHOD OF APPLYING SURFACE LAYERS

The present invention refers to a road finisher for applying at least two surface layers as well as to a method for applying these surface layers.

BACKGROUND OF THE INVENTION

In the case of a road finisher used for applying and compacting two asphalt layers and known from DE-A1-43 42 997, the first road-surface applying device is a scraper which is dragged behind a lateral distributor and which applies the first road-surface layer such that the correct height is obtained. A road-surface applying device dragged behind an additional lateral distributor is constructed as a road-surface applying screed provided with a compacting system, said road-surface applying screed applying and compacting the second surface layer and compacting through said second surface layer also the first one. The degree of compacting which can be achieved is not satisfactory. If the surface layer has to fulfil high requirements, expensive rerolling will be necessary.

A road finisher known from DE-A1-23 14 812 is constructed like a slip form concrete paver provided with a square frame, which is supported by separately driven tracklaying gears and which has arranged therein two successive, transversely displaced road-surface applying screeds. This finisher is not suitable to be used for applying multilayer concrete layers, in view of the fact that both road-surface applying screeds act on the same road-surface layer and in view of the fact that the provision of two road-surface applying screeds only serves the purpose of making the mounting width adjustable.

Multilayer concrete layers are increasingly produced instead of bituminous pavements. In particular heavy trucks subject the road constructions to the following loads: high static and dynamic wheel loads, tyre treads, acceleration and deceleration, vehicle speed, traffic density, and climatic influences occurring during the traffic. The road superstructure normally consists of one or more support layers and of the pavement. Its thickness is chosen in dependence upon the traffic load, the climatic conditions and the sensitivity to frost. The support layers have the function of transmitting the traffic loads from the pavement into the underground or road foundation without deforming the road level.

Support layers consists e.g. of unbound or bound mixtures of mineral substances. For bound support layers, bitumen binders or hydraulic binders are used. Unbound support layers are the frost blanket, the support layer consisting of broken stone and the support layer consisting of gravel. The frost blanket is the first support layer of the road superstructure and prevents capillary water from penetrating into the superstructure. Bound support layers comprise hydraulically bound support layers, concrete support layers or bituminous support layers.

A concrete support layer is used when the ground in question is a settlement-sensitive kind of ground. It consists e.g. of concrete B 15 or B 25 according to DIN 1045 with an application thickness of approx. 15 cm, and up to now it has been produced by a conventional slip form concrete paver or a rail- mounted concrete finisher. This layer must be provided with transverse and longitudinal joints and it must be protected against drying out after have been applied. Concrete pavements are predominantly used for traffic areas that are subjected to heavy loads, such as motorways, landing fields and farm ways. They are temperature-insensitive and have a long service life; in addition, they are bright, abrasion-resistant and they have skid resisting properties. Up to now, concrete pavements have been applied in a single layer or by means of a slip form concrete paver in one operation in a two-layered structure with concrete mixtures of different compositions.

Slip form concrete pavers are disadvantageous insofar as they can only be used for compacting concrete which is very easy to compact and which has a w/z value>0.4, but this type of concrete cannot be walked on immediately. Less expensive is the use of a road finisher which is provided for bituminous road construction. By means of such a road finisher, rolled concrete (RCC) can be applied, i.e. a heterogeneous mass of cement concrete, which must, however, be recompacted by vibrating rollers and rubber-tyred rollers. In view of the small amount of machinery required, an essential reduction of costs can be achieved in this way in comparison with conventional concrete application by means of slip form concrete pavers.

The best solution for applying concrete pavements is, however, offered by the so-called PCC technology, which can be applied when a road finisher with a high-compaction road-surface applying screed (DE-C-31 14 049) is used; the concrete which is applied and highly compacted is in this case semidry concrete which is difficult to compact and which is composed of grain sizes of 0–2 (sand), 2–8 (gravel) and 8–22 (broken material). The result is a concrete with high stability and a proctor density of 96% at a depth of 15 cm, which, due to the compacting effect of the high-compaction screed, can be walked on immediately without any permanent footprints being caused. During application, attention should be paid to the optimum water content. A road surface true to profile without any lateral edge and with the highest possible flatness can be achieved. Such a road finisher equipped with a high-compaction road-surface applying screed can also be used for applying drain concrete or low-noise concrete whose advantages are very high noise reduction (=≧−5 dB (A)), good drain behaviour, i.e. no spray water, no aquaplaning, high load- bearing capacity (cavity content =≧15 percent by volume), good skid resisting properties in the case of dry and wet surfaces, high deformation stability and advantageous thermal properties, e.g. little heating up during the summer. PCC, drain or low-noise concretes require in certain cases a multilayer application to a support layer with or without bonding bridge; a subconcrete layer may be produced from wet PCC and must be adapted to be travelled on by the road finisher. In other cases, the subconcrete layer may also be an already existing concrete road construction. However, a road finisher provided with a high-compaction road-surface applying screed has, up to now, only been adapted to be used for applying and compacting a single surface layer.

DE-U-93 13 161, FR-A-26 97 036, EP-A-0 536 052, DE-U-93 17 124 and U.S. Pat. No. 4,073,592 belong to the technological background as well.

SUMMARY OF THE INVENTION

It is the object of the present invention to provide a road finisher of the type mentioned at the beginning by means of which high-quality, multilayer concrete pavements can be applied as well as a method of producing this concrete pavement construction.

In accordance with the present invention, and other objects are achieved by the structures and process disclosed herein and set forth in the various claims.

Firstly, the road finisher applies each surface layer such that the correct height is obtained, and, secondly, it compacts each surface layer immediately to a high degree. The concrete high-compaction road-surface applying screed is specially adapted to premix concrete. Rerolling of the concrete pavement construction can be dispensed with. The quality of the concrete pavement construction obtained is higher than that obtained when the concrete pavement is applied by means of a slip form concrete paver. Furthermore, the costs entailed by the method carried out by means of this road finisher are much lower.

Additionally, the tamper device located at the front provides precompacting and smoothing before the compacting and smoothing processes are continued by the smoothing plate. The compacting strip finally produces the necessary high final compaction. In this connection, it is particularly important that the compacting strip is pressed onto the surface layer with downwardly directed swelling force pulses and without causing any impact effect so that the swelling forces penetrate deeply into the surface layer without smashing the grains. In view of the fact that the reaction forces resulting from the swelling force application are directed upwardly against the total mass of the road-surface applying screed which acts as an abutment, extremely high compacting forces can be produced in the dynamic phase in which the swelling force pulses act on the surface layer with a frequency that is higher than the natural frequency of the total mass of the screed; the value of said compacting forces can be higher than the weight of the total mass of the screed. Additional information on the high-compaction effect produced by such road-surface applying screeds can be inferred from DE-C-31 14 049, which is herewith referred to.

Another particularly important feature is that the reduced contact angle of the tamper device is particularly suitable for processing and precompacting concrete.

An additional important embodiment disclosed and claimed includes a bonding additive, by which a bonding bridge is produced in cases where a special connection must be established between the surface layers, i.e. where special adherence is required between a lowermost support layer or an old concrete pavement or bitumen pavement and the first surface layer applied. The production of the bonding bridge by means of the same road finisher which also applies the surface layers is ecologically desirable, moderate in price and effective.

In the case of another embodiment, two or more compacting strips share the task of highly compacting the surface layer. It is, however, also imginable to use one broad compacting strip, the contact angle of which is adapted to concrete.

In the case of another embodiment, more than two surface layers are applied by one and the same road finisher.

Other embodiments prevent the high-compaction road-surface applying screeds from obstructing each other when the road finisher is in operation. In addition, this type of coupling provides production and mounting advantages.

A particularly expedient embodiment is where the premix containers consist of replaceable concrete containers, which are filled separately from the finisher, transported to said finisher and exchanged within a short period of time.

Another embodiment avoids downtimes of the road finisher during road construction.

The measure of constructing the spray device as a spraying beam means provides a spray area for the bonding bridge which extends continuously throughout the respective mounting width.

Another embodiment prevents the travelling mechanism from damaging or destroying the bonding bridge and from getting soiled by the bonding additive.

In another embodiment most of the bonding bridge is applied already in front of the travelling mechanism, whereas the areas which are not acted upon in front of said travelling mechanism are only filled with bonding additive behind said travelling mechanism. This embodiment solves the problem that the amount of mounting space available behind the chassis and in front of the first lateral distributor is normally limited.

In the case of another embodiment, the application width of the concrete pavement construction can be varied.

The method according to the present invention solves in a simple manner the problem arising in connection with the application of multilayer concrete pavement constructions due to the fact that the road finisher cannot travel on the respective lower surface layer as long as said surface layer is still in the wet state, said wet state being, however, advantageous for obtaining an effective connection with the superimposed surface layer. In view of the fact that all surface layers are applied in an overlapping arrangement by one and the same road finisher and are highly compacted separately from one another, a very firm bond will be obtained and the concrete pavement construction will be finished in one operation at a moderate price. Rerolling is no longer necessary.

As a variation of this method, two or more concrete layers are applied in one operation, the semidry consistency permitting good processability on the one hand and a very effective connection of the surface layers on the other.

In the case of another method variation, the first surface layer provided is a hydraulically bound support layer, which is also applied by the same road finisher as the subsequent concrete pavement layer(s).

A further method variation is important, if the ground is an old concrete or bitumen layer or perhaps also a hydraulically bound support layer.

BRIEF DESCRIPTION OF THE DRAWINGS

Embodiments of the subject matter of the present invention are explained making reference to the drawings, in which.

DESCRIPTION OF THE PREFERRED EMBODIMENTS

Figure 1:
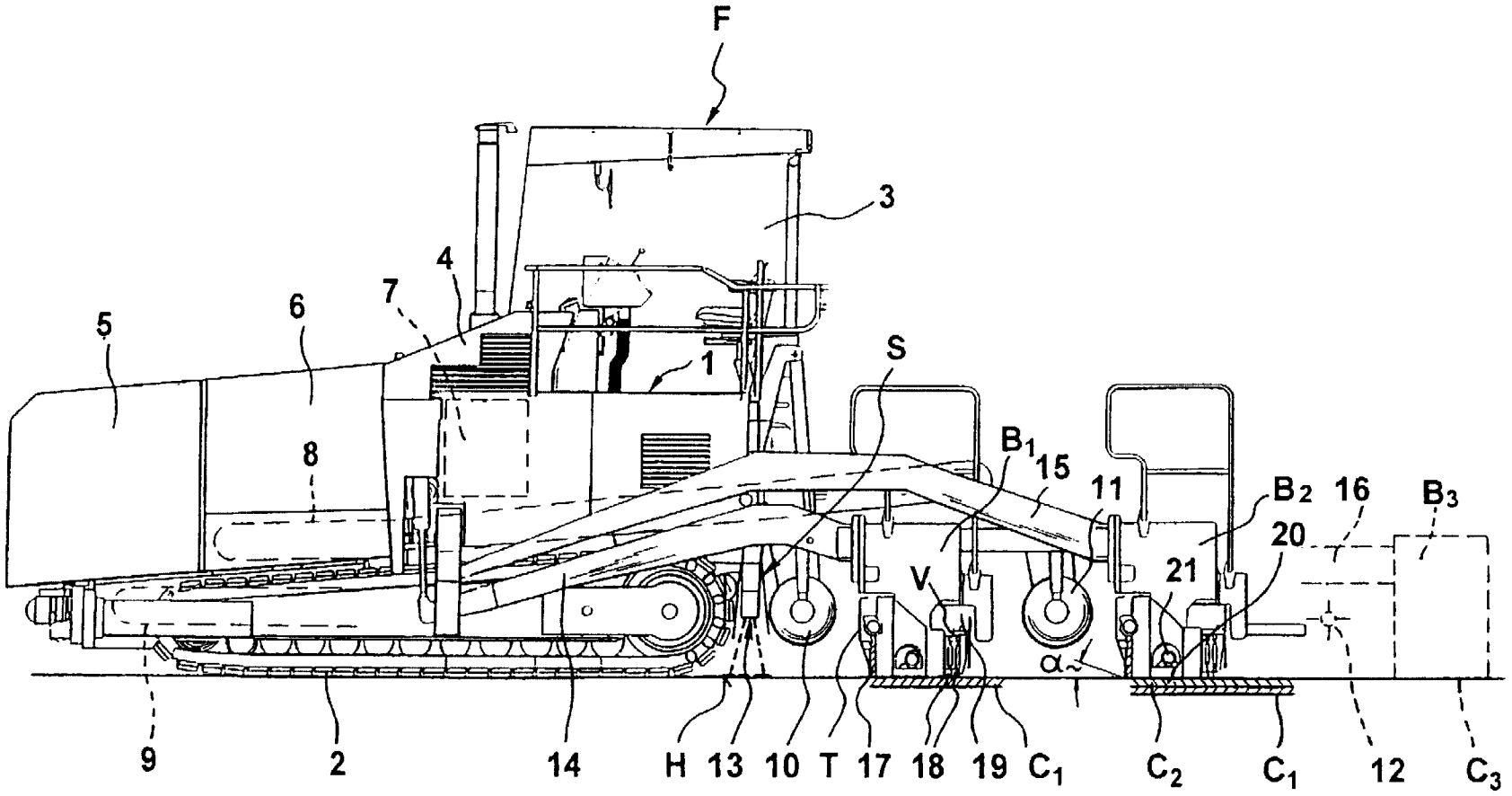
FIG. 1 shows a side view of a road finisher according to the present invention.

A road finisher F according to FIG. 1 comprises a chassis 1 with a travelling mechanism 2 (wheel or tracklaying gear) and a driver's cabin 3 adjacent a primary drive unit 4 (diesel-hydraulic or diesel-electric drive unit). In the front part of the chassis 1, at least two premix containers 5, 6 are arranged. In addition, a bonding-additive tank 7 is provided. Each premix container 5, 6 is connected to a separate area, which is located behind the chassis 1 when seen in the driving direction of the finisher (FIG. 1 to the left), via a separate conveyor path 8, 9 (conveyor belts, screw conveyors or scraper-chain conveyors). Conveyor path 9 leads to a lateral distributor 10 (spreading screw) arranged immediately after the end of the chassis 1, whereas conveyor path 8 leads to an additional lateral distributor 11 (spreading screw) which is arranged further to the rear than the first lateral distributor 10. If a third or even more than three premix containers (not shown) are provided on the chassis, an additional conveyor path (not shown) leads from the respective premix container to a lateral distributor 12 which is located even further to the rear.

Figure 2:
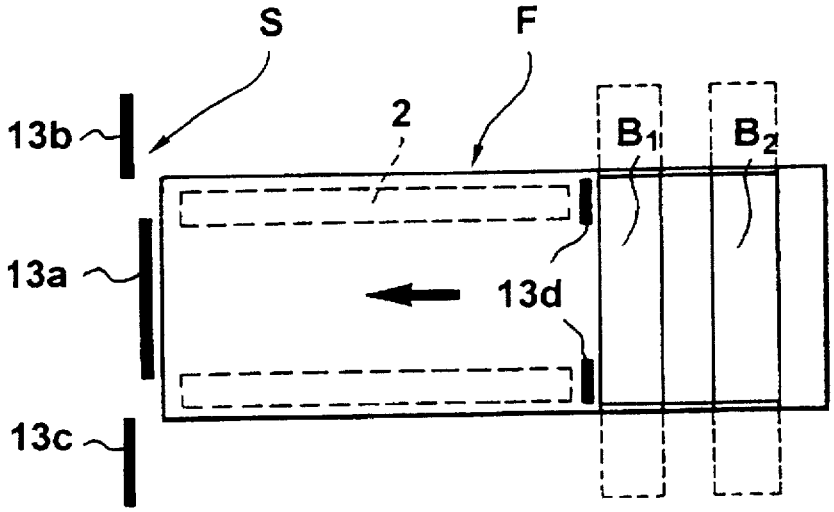
FIG. 2–4 show schematic views, seen from below, of embodiments of the road finisher according to FIG. 1.
Figure 3:
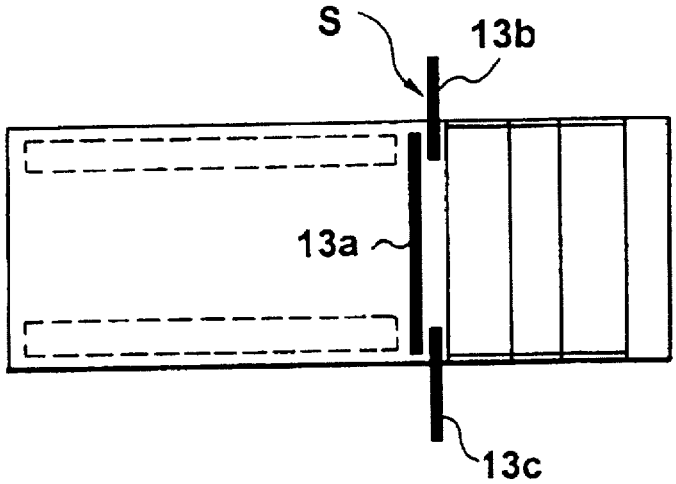
Figure 4:
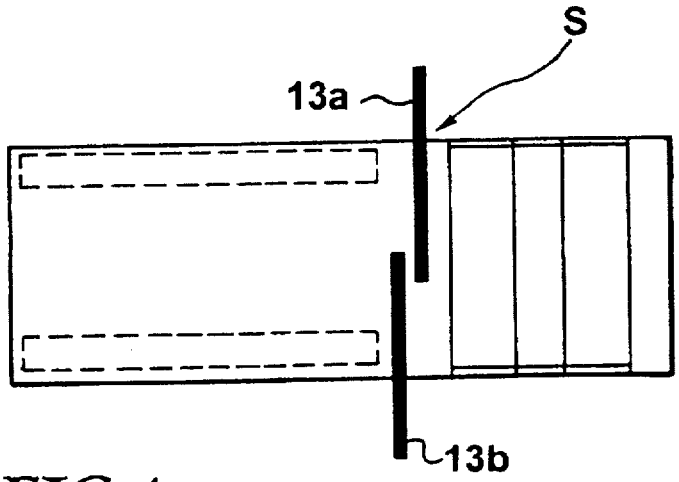

The chassis 1 has additionally provided thereon a spray device S for a bonding additive; in FIG. 1, a spraying beam 13 is arranged immediately behind the travelling mechanism on the chassis 1. FIG. 2–4 show detail variations of the spray device S.

According to FIG. 1, the chassis 1 has connected thereto lateral outriggers 14, 15, which each drag a high-compaction road-surface applying screed B1 and B2. If a third premix container (not shown) is provided on the chassis 1, an additional high-compaction road-surface applying screed B3 will be dragged via outriggers 16 outlined by a broken line.

The high-compaction road-surface applying screed B1 arranged closest to the chassis 1 applies the premix which is transversely distributed by the lateral distributor 10. The high-compaction road-surface applying screed B2 applies the premix which is transversely distributed by the second lateral distributor 11. The possibly provided third high-compaction road-surface applying screed B3 applies the premix distributed by the lateral distributor 12. The high-compaction road-surface applying screed B1 produces a first highly compacted surface layer C1 which has applied thereto a further highly-compacted road-surface layer C2 by the second high-compaction road-surface applying screed B2 before the possibly provided third high-compaction road-surface applying screed B3 applies another highly-compacted surface layer C3.

Each high-compaction road-surface applying screed B1, B2, B3 can have a predetermined mounting width and, if necessary, its mounting width can be enlarged or reduced by laterally attachable extension members. It is, however, also imaginable to construct each high-compaction road-surface applying screed B1, B2, B3 as so-called telescopic screed whose mounting width can be varied steplessly by at least one laterally extendable telescoping member (and, if desired, extension members mounted thereon).

At least the high-compaction road-surface applying screeds B2, B3 each carry a tamper device T which is located at the front and which comprises at least one tamper strip 17 having a contact angle $\alpha$ of approx. 30° that is adapted to concrete. The tamper strip 17 is moved up and down with a selectable frequency by means of a drive, which is not shown, so as to precompact and level the transversely distributed road-surface material. The tamper device T is followed by at least one smoothing plate 20 which is provided on the bottom side and which is acted upon by a vibration driver 21 in an expedient manner, the surface layer being smoothed and further compacted by said smoothing plate 20. The smoothing plate 20 is followed by at least one transversely extending (broader) compacting strip 18 or (as shown) by preferably two transversely extending, successive compacting strips 18, which are acted upon by downwardly directed swelling force pulses via swelling force drives 19, the respective reaction forces resulting from the swelling force pulses being directed upwards straight against the total mass of the high-compaction road-surface applying screed B1, B2, B3 which acts as an abutment. In this way, a high-compacting device V is formed in each high-compaction road-surface applying screed B1, B2, B3, said high-compacting device V imparting to the applied surface layer C1, C2, C3 a compaction which is so high that rerolling can be dispensed with.

For providing high-quality adherence between the ground and the first surface layer C1, a bonding bridge H can be applied to the ground by means of the spray device S.

According to FIG. 2, three sections **13*a*, 13*b* and 13*c* of the spraying beam 13 of the spray device S are arranged in front of the travelling mechanism 2 in such a way that the areas where the travelling mechanism 2 contacts the ground are not acted upon. Immediately behind the travelling mechanism 2, two additional sections 13*d* of the spraying beam 13** are provided, with the aid of which the above-mentioned areas are acted upon.

In the case of the embodiment according to FIG. 3, three sections **13*a*–13*c* of the spraying beam 13 are arranged behind the travelling mechanism 2 in such a way that the whole mounting width of the high-compaction road-surface applying screeds B1 and B2** is covered.

In the case of the embodiment according to FIG. 4, only two sections **13*a* and 13*b* of the spraying beam 13** are provided, said two sections overlapping each other in transverse direction.

In the case of all the embodiments of FIG. 2–4, said sections **13*a*–13*c* are adapted to be adjusted transversely and relative to one another so as to adapt the width of the bonding bridge to the mounting width of the high-compaction road-surface applying screeds B1, B2 and B3**.

The road finisher F according to FIG. 1 (provided with the high-compaction road-surface applying screeds B1 and B2) can, for example, be used for applying to a prepared base, e.g. an old concrete or bitumen pavement, first a bonding bridge H prior to applying a PCC concrete surface layer as a support layer, which has then again applied thereto a PCC concrete layer as road surface (wet-wet-solid). It is, however, also possible to apply drain concrete to the PCC support layer as a road surface. If the road finisher F is provided with three high-compaction road-surface applying screeds B1, B2 and B3, as shown in FIG. 1, a hydraulically bound support layer, e.g. mineral matter with water, cement, lime or bitumen, can be applied as a first support layer to the prepared base, said first support layer having then applied thereto a PCC concrete surface layer as a second support layer. The PCC concrete surface layer has finally applied thereto drain concrete. Other combinations of different types of layers are also possible. It is also imaginable to attach more than three high-compaction road-surface applying screeds so as to apply two or three surface layers simultaneously.

What is claimed is:

1. A road finisher for simultaneously applying at least two surface layers, comprising a chassis, a travelling mechanism, at least two premix containers arranged on said chassis, a lateral distributor associated with each respective premix container, each lateral distributor being arranged behind the chassis and adapted to have material supplied thereto from its premix container via a conveyor path extending in the chassis, and further comprising lateral outriggers attached to the chassis, a dragged road-surface applying device for applying a surface layer being arranged on said outriggers behind each lateral distributor, each road-surface applying device being a rear high-compaction road-surface applying screed for recompaction-free application of a surface layer, and each rear high-compaction road-surface applying screed constructed to be used for applying and compacting concrete and including a tamper device located at the front of the screed and at least one transversely extending high-compaction compacting strip separated from said tamper device by a smoothing plate which is adapted to be acted upon by means of a vibration device, said compacting strip being operatively connected to at least one swelling force drive, each swelling force drive being arranged in a high-compaction road-surface applying screed in such a way that its upwardly directed reaction force resulting from the force applied to the compacting strip is directed straight against the total mass of the high-compaction road-surface applying screed which acts as an abutment, said tamper device having a tamper-strip contact angle that is smaller than 45°.

2. A road finisher for simultaneously applying at least two surface layers, comprising a chassis, a travelling mechanism, at least two premix containers arranged on said chassis, a lateral distributor associated with each respective premix container, said lateral distributor being arranged behind the chassis and adapted to have material supplied thereto from its premix container via a conveyor path extending in the chassis, and further comprising lateral outriggers attached to the chassis, a dragged road-surface applying device for applying a surface layer being arranged on said outriggers behind each lateral distributor, each road-surface applying device being a rear high-compaction road-surface applying screed for recompaction-free application of a surface layer, and each rear high-compaction road-surface applying screed constructed to be used for applying and compacting concrete and including a tamper device located at the front of the screed and at least one transversely extending high-compaction compacting strip separated from said tamper device by a smoothing plate which is adapted to be acted upon by means of a vibration device, said compacting strip being operatively connected to at least one swelling force drive, each swelling force drive being arranged in a high-compaction road-surface applying screed in such a way that its upwardly directed reaction force resulting from the force applied to the compacting strip is directed straight against the total mass of the high-compaction road-surface applying screed which acts as an abutment, and at least one bonding-additive tank arranged on the chassis and connected to a spray device arranged on said chassis.

3. A road finisher according to claim 2, wherein each high-compaction road-surface applying screed is provided with two successive pressing strips.

4. A road finisher according to claim 2, wherein the spray device is provided with a transversely extending spraying beam consisting of a plurality of sections defining a spray area that extends continuously over the whole mounting width of the high-compaction road-surface applying screeds.

5. A road finisher according to claim 4, wherein all the sections of the spraying beam are arranged behind the travelling mechanism.

6. A road finisher according to claim 4, wherein the sections of the spraying beam are arranged in front of the travelling mechanism in such a way that the areas where the travelling mechanism contacts the ground are not acted upon by said spray means, and that, behind the travelling mechanism, short sections of the spraying beam are arranged, said short sections covering the areas which are not acted upon by the front sections.

7. A road finisher for simultaneously applying at least two surface layers, comprising a chassis, a travelling mechanism, at least two premix containers arranged on said chassis, a lateral distributor associated with each respective premix container, said lateral distributor being arranged behind the chassis and adapted to have material supplied thereto from its premix container via a conveyor path extending in the chassis, and further comprising lateral outriggers attached to the chassis, a dragged road-surface applying device for applying a surface layer being arranged on said outriggers behind each lateral distributor, each road-surface applying device being a rear high-compaction road-surface applying screed for recompaction-free application of a surface layer, and each rear high-compaction road-surface applying screed constructed to be used for applying and compacting concrete and including a tamper device located at the front of the screed and at least one transversely extending high-compaction compacting strip separated from said tamper device by a smoothing plate which is adapted to be acted upon by means of a vibration device, said compacting strip being operatively connected to at least one swelling force drive, each swelling force drive being arranged in a high-compaction road-surface applying screed in such a way that its upwardly directed reaction force resulting from the force applied to the compacting strip is directed straight against the total mass of the high-compacting road-surface applying screed which acts as an abutment, at least one of the rear high-compaction road-compaction road-surface applying screeds being coupled by means of an outrigger to an outrigger of a preceding high-compaction road-surface applying screed.

8. A road finisher according to claim 7, wherein at least one of the premix containers is a concrete container which is replaceably arranged on the chassis.

* * * * *